United States Patent [19]

Feuz

[11] Patent Number: 4,843,970

[45] Date of Patent: Jul. 4, 1989

[54] OVERHEAD CABLE TRANSPORT INSTALLATION CONTAINING A TRANSFER SECTION BETWEEN A DISEMBARKING SECTION AND AN EMBARKING SECTION

[75] Inventor: Fritz Feuz, Thun, Switzerland

[73] Assignee: Von Roll Transportsysteme AG, Thun, Switzerland

[21] Appl. No.: 132,897

[22] Filed: Dec. 14, 1987

[30] Foreign Application Priority Data

Dec. 18, 1986 [CH] Switzerland ..... 5107/86

[51] Int. Cl.[4] ..... B61B 11/00

[52] U.S. Cl. ..... 104/27; 104/18; 104/20; 104/21; 104/28; 104/31

[58] Field of Search ..... 104/21, 23, 27, 28, 104/18, 19, 20, 27, 28, 31

[56] References Cited

U.S. PATENT DOCUMENTS

| | | | |
|---|---|---|---|
| 3,552,321 | 1/1971 | Priebe | 104/18 |
| 3,799,060 | 3/1971 | Johnson | 104/18 |
| 4,602,566 | 7/1986 | Kernkamp et al. | 104/91 |

FOREIGN PATENT DOCUMENTS 0245163 11/1987 European Pat. Off. .

*Primary Examiner*—Richard A. Bertsch
*Attorney, Agent, or Firm*—Cushman, Darby & Cushman

[57] ABSTRACT

The overhead cable transport installation possesses at each of the stations a transfer section between a disembarking section and an embarking section. At a still linear starting section of each transfer section there are provided driven wheels and at the linear end or terminal section of each transfer section there are likewise provided driven wheels. The driven wheels at the starting section are driven at a stepped greater rotational speed in relation to wheels located at the disembarking section, so that vehicles of the overhead cable transport installation arriving in the transfer section can be accelerated by the driven wheels engaging at friction shoes of the vehicle. A chain conveyor extends between the driven wheels of the starting section of the transfer section along the latter and transports the vehicles at an increased velocity and with a correspondingly greater mutual spacing from one another through curved portions of the transfer section. The driven wheels at the terminal section, which are driven by the wheels of the embarking section at a stepped greater rotational speed, again decelerates each vehicle prior to it arriving at the embarking section. At the disembarking section and the embarking section the vehicles thus can be moved at a lesser velocity and at minimum spacing or pitch from one another without vehicles colliding at the curved sections of the transfer section. The number of vehicles located at any given time at the transfer section can be maintained small.

9 Claims, 2 Drawing Sheets

OVERHEAD CABLE TRANSPORT INSTALLATION CONTAINING A TRANSFER SECTION BETWEEN A DISEMBARKING SECTION AND AN EMBARKING SECTION

CROSS-REFERENCE TO RELATED APPLICATIONS

This application is related to the commonly assigned, co-pending U.S. application Ser. No. 07/061,623, filed June 15, 1987, and entitled "OVERHEAD CABLE TRANSPORT INSTALLATION, ESPECIALLY AERIAL CABLEWAY", now U.S. Pat. No. 4,794,864, granted Jan. 3, 1989, and the commonly assigned, co-pending U.S. application Ser. No. 07/132,988, filed Dec. 14, 1987, and entitled "OVERHEAD CABLE TRANSPORT INSTALLATION CONTAINING A TRANSFER SECTION EQUIPPED WITH A CLOCK CONVEYOR".

BACKGROUND OF THE INVENTION

The present invention relates to a new and improved construction of an overhead cable transport installation, especially an aerial cableway.

Generally speaking, the overhead cable transport installation, especially the aerial cableway of the present development which is capable of operating at relatively high conveying capacities, is of the type comprising at least one travelling transport cable which revolvingly moves or circulates between two stations. Vehicles, such as gondolas or cabins by way of example but not limitation, which, however, also could be constituted by, for instance, chair lifts, are coupled with such revolvingly moving cable. There is also provided a path of travel or travelling path for the vehicles at least at one station when the vehicles are de-coupled or released from the travelling cable. This travelling path or path of travel comprises, viewed in the direction of travel of the vehicles, a deceleration section or path, a disembarking section or path, a transfer section or path, an embarking section or path and an acceleration section or path. There are also provided brake or braking means in order to reduce the travel velocity of the vehicles at the deceleration section or path and drive means in order to increase the travel velocity of the vehicles at the acceleration section or path. Equally, there are provided conveyor or conveying means for maintaining the vehicles in motion when located at the disembarking section or path, the transfer section or path and the embarking section or path.

Overhead cable transport installations of the aforementioned type are well known in this technology as revolving transport or conveying devices operating at high conveying capacity. This conveying capacity is predicated, apart from the comparatively high velocity of movement of the travelling transport cable, upon the presence of a large number of vehicles which are continuously in revolving or circulating motion during their transit between respective stations.

The time interval between successive vehicles —also conveniently referred to in the art as "clock"—is constant throughout the entire revolving path of travel for such conveyor installations and accordingly remains unchanged also when the vehicles pass through the stations. On the other hand, the travel velocity of the vehicles at the embarking section or path and at the disembarking section or path is necessarily appreciably smaller than the velocity of the vehicles when coupled with the travelling transport cable. It will therefore be readily appreciated that as a result of these conditions the situation necessarily arises that for the same time interval two directly successive or neighboring vehicles approach that much closer to one another the smaller the vehicle travel velocity is maintained at the embarking and disembarking sections. However, there are limits placed upon how close the vehicles can approach one another and, specifically, such is dictated by the contour or outline dimensions of the vehicles, for instance the vehicle cabin or gondola by way of example, as well as the smallest arc radius or radius of curvature for the transfer section or path between the embarking section and the disembarking section.

These dimensions, which as a general rule are fixed by the design of the overhead cable transport installation, govern the smallest geometric spacing or pitch between the successive vehicles, and thus, for a given vehicle travel velocity, also the aforementioned time interval or clock of the installation.

With the aim of achieving a further increase in the conveying capacity attempts have been made with a number of aerial cableways which are presently in operation to avoid critical approach or proximity of the vehicles at the transfer section or path by providing a high vehicle velocity during embarking and disembarking. However, high vehicle velocities at the embarking and disembarking sections are at least discomforting for the users of the aerial cableway system, if not in fact under certain conditions dangerous and likely to promote accidents.

SUMMARY OF THE INVENTION

Therefore, with the foregoing in mind it is a primary object of the present invention to provide a new and improved construction of an overhead cable transport installation which is not afflicted with the aforementioned drawbacks and shortcomings of the prior art proposals.

Another and more specific object of the present invention aims at providing a new and improved construction of an overhead cable transport installation wherein, while concommitantly improving the economies or efficiencies of the overhead cable transport installation, the course or layout of the transfer section or path does not have any influence upon the smallest geometric mutual spacing of the vehicles, such as the cabins or gondolas or even chair lifts from one at the embarking section and the disembarking section can be maintained small and thus comfortable for the users embarking at the vehicles and disembarking from the vehicles.

Yet a further significant object of the present invention aims at the provision of a new and improved construction of an overhead cable transport installation, especially an aerial cableway, which contains a transfer section located between a disembarking section and an embarking section, wherein the disembarking and embarking operations can be carried out comfortably by and without any appreciable danger for the passengers or users of the installation, whereas at the transfer section the empty vehicles located thereat can be conveyed in a manner which, while affording the aforenoted advantages, still allows the achievement of a high conveying capacity for the overhead cable transport installation.

Still a further significant object of the present invention is directed to the provision of a new and improved construction of an overhead cable transport installation which affords high conveying capacities or efficiencies with a design of relatively simple construction which is nonetheless highly reliable in operation, not readily subject to breakdown or malfunction, requires a minimum of maintenance and servicing, and affords enhanced comfort and relatively easy use for the passengers of the overhead cable transport installation.

Now in order to implement these and still further objects of the invention, which will become more readily apparent as the description proceeds, the overhead cable transport installation, especially the aerial cableway, of the present development is manifested by the features that the conveyor or conveying means of the transfer section or path contain, apart from the means which convey the vehicles at a constant velocity in the intended direction of travel of the vehicles at the transfer section or path, acceleration means which are effective before or upstream of the means conveying the vehicles at constant velocity and also deceleration means which are effective, viewed with respect to the direction of vehicle travel, after or downstream of the means conveying the vehicles with substantially constant velocity.

By arranging the acceleration means at the start of the transfer section or path and forwardly or upstream of the arcuate or curved portion thereof, it is beneficially possible to space successive vehicles at least at such a distance from one another that the vehicle cabins or gondolas or the like, also possess a sufficient mutual spacing from one another even in curved portions of the transfer section.

An unexpected advantage of the inventive solution resides in the fact that for given structural conditions or parameters of the overhead cable transport installation, a smaller number of vehicles are in revolving motion in order to maintain a predeterminate clock (time interval). The vehicles move through the transfer section or path in a shorter period of time owing to the higher mean or average vehicle velocity. Since the transfer section or path constitutes the so-called dead zone of the installation, in other words an inactive region where there are not transferred users or passengers of the installation, there beneficially arises by virtue of the reduction of the number of vehicles which are in transit an improvement in the economies of the system. On the other hand, the structural expenditure in equipment for constructing the inventive overhead cable transport installation and realizing the noteworthy benefits, is relatively modest.

Since the solution proposed by the invention allows operating the vehicles with small travel velocities at the embarking section and disembarking section, these sections or paths can be designed so as to be relatively short in length without any drawbacks for the passengers or users. This advantage also affords the further benefit that, as a general rule, there can be constructed shorter station buildings or structures. Such is not only cost favorable in terms of the actual construction costs, but additionally also can be beneficial in terms of the design and layout of the overhead cable transport installation.

A further advantage of the invention resides in the fact that by virtue of the greater geometric spacing or distance between successive vehicles located at the transfer section or path, which is obtained by virtue by of the higher vehicle velocity at the transfer section, a switch arrangement at this transfer section can also be activated during normal operation of the installation for shunting-in and shunting-out a vehicle. This can be of significance for the transport of handicapped persons or the like or when transporting goods or materials.

The invention can also be incorporated at a transfer section which operatively interconnects two sections an installation with one another.

The acceleration means and the deceleration means are preferably constituted by wheels or wheel members which are driven at appropriate rotational speeds and coact with friction elements, such as friction shoes or equivalent structure, which are mounted at the vehicles. In order to enable driving these wheels or wheels members at different rotational speeds, an advantageous design of the system contemplates interconnecting these wheels with one another by endless power transmission elements, for instance by V-belts which are guided over belt pulleys having different diameters. The drive of the wheels or wheel members is advantageously derived from the drive of the cable pulley or sheave or equivalent structure driving the travelling transport cable.

The means of the transfer section which conveys the vehicles at a substantially constant velocity are advantageously constructed as conventional chain conveyors. These chain conveyors take over the vehicles from the acceleration means at the correspondingly increased velocity, moves such vehicles through the curved portions or arcuate vehicles to the deceleration means.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
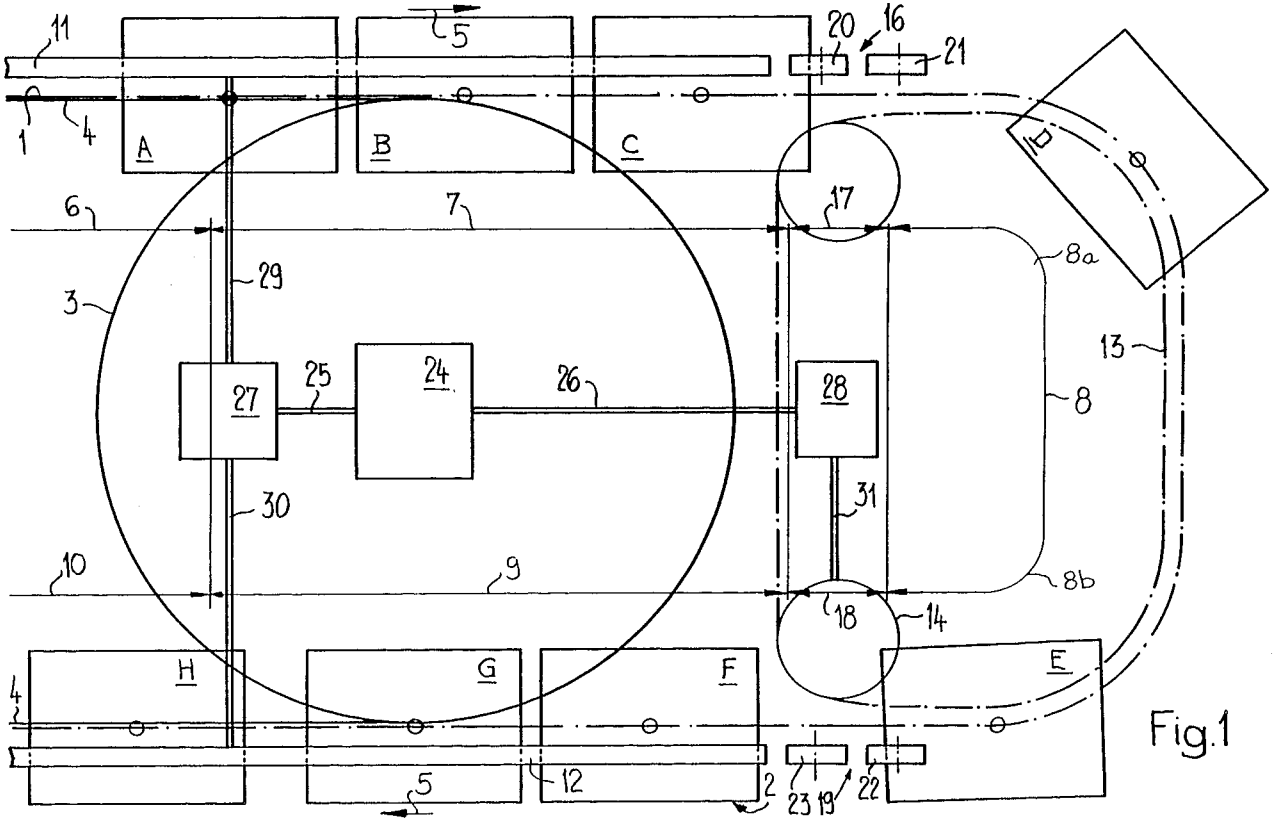
FIG. 1 schematically illustrates in top plan view a station of a revolving or circulating single cable overhead cable transport installation, for instance an aerial cableway, constructed according to the present invention.

Describing now the drawings, it is to be understood that only enough of the construction of the overhead cable transport installation has been depicted in the drawings to simplify the illustration thereof and as needed for those skilled in the art to readily understand the underlying principles and concepts of this invention.

Figure 2:
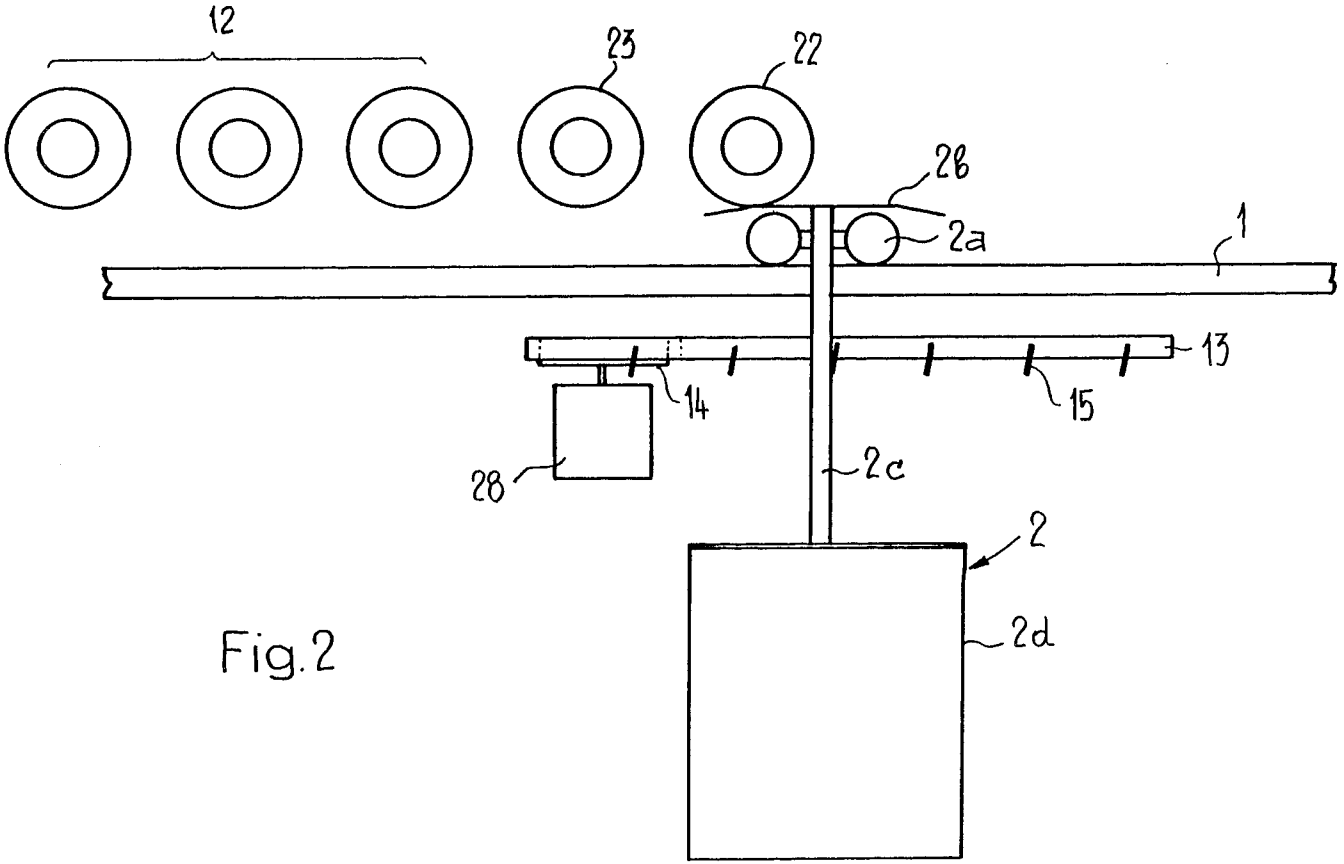
FIG. 2 illustrates on an enlarged scale and in elevational view a detail of the arrangement of FIG. 1.

Furthermore, in FIGS. 1 and 2 of the drawings, there has been depicted, purely by way of example and not limitation, as the overhead cable installation an aerial cableway, such as a gondola lift although other types of overhead cable transport installations are equally contemplated, such as, for instance, a chair lift. Furthermore, while the overhead cable installation of the present invention will be described in conjunction with the transport of passengers, it should be evident that it could be employed in other fields of application, for instance for transporting goods or materials. Additionally, while the invention will be described as a matter of simplicity with regard to a given station or terminal of the overhead cable transport installation, it should be readily apparent that each such station or terminal normally would be equipped with the apparatus structure of the present development.

Turning now specifically to FIGS. 1 and 2 of the drawings, reference numeral 1 designates a travel rail or track system which at the station or terminal under consideration defines a substantially U-shaped travel path for the transport vehicles 2, such as the gondolas or cabins or equivalent transport facilities. A support and travelling transport traction cable 4 travels around a cable pulley or sheave 3 or equivalent structure. The travel rail or track system 1 receives the suspended vehicles 2 at their carriages 2*a* or the like, as depicted in FIG. 2, when such vehicles 2 arrive or inbound at the station and as soon as such vehicles 2 are conventionally de-coupled in appropriate fashion from the travelling transport cable or cable member 4.

The direction of travel of the vehicles 2 has been indicated by the arrows 5. The travel rail or track system 1 extends in the vehicle travel direction 5, starting from a deceleration section or path 6 successively through a disembarking or exiting section or path 7, a transfer section or path 8, an embarking or entry section or path 9 as well as an acceleration section 10. As indicated in FIG. 1 respective sets of wheels or wheel members 11 and 12, arranged above the travel rail or track system 1, extend, on the one hand, along the deceleration section or path 6 and the disembarking section or path 7 and, on the other hand, along the embarking section or path 9 as well as the acceleration section or path 10.

These sets of wheels 11 and 12 can be designed and driven in the manner, for instance, as disclosed in the aforementioned commonly assigned, co-pending U.S. application Ser. No. 07/061,623, filed June 15, 1987, now U.S. Pat. No. 4,794,864, granted Jan. 3, 1989, to which reference may be readily had and the disclosure of which is incorporated herein by reference.

Although the wheels of both sets of wheels 11 and 12 which are disposed at the region of the disembarking section 7 and the embarking section 9, respectively, are driven so that they possess the same rotational speed, those wheels or wheel members which are located at the region of the deceleration section 6 and the acceleration section 10, respectively, are respectively driven such that they have mutually different rotational speeds. As far as the deceleration section 6 is concerned the rotational speed of the related wheels progressively decrease in the direction of travel 5 of the vehicles 2 and at the acceleration section 10 the related wheels progressively increase in rotational speed in the direction of travel 5 of the vehicles 2. As will be understood by referring to FIG. 2, the wheels of the wheel sets 11 and 12, and in the illustration of FIG. 2 in particular there are depicted the wheels 12 at the region of the embarking section 9, function as friction wheels at friction elements, here shown as friction shoes 2*b* provided for the vehicles 2 and specifically carried by the related vehicle carriage 2*a*. Consequently, the wheels or wheel members of the related sections or paths decelerate or accelerate, as the case may be, the vehicles 2 following the transfer of these vehicles 2 from the cable 4 or prior to the transfer of the vehicles 2 into operative engagement with the cable 4, as the case may be. The wheels of the deceleration section 6 advantageously function as braking devices or expedients, whereas the wheels of the acceleration section 10 advantageously serve as drive means for the vehicles 2.

Reference numeral 13 generally designates a conveyor system comprising a conventional chain conveyor or conveyor device which is arranged at the transfer section or path 8 beneath the travel rail or track system 1 and contains a drive wheel 14 or equivalent drive structure. This chain conveyor 13 is provided with entrainment members 15 which operatively engage with the suspension system or suspension means 2*c* of an associated vehicle 2 and carrying the cabin 2*d* or the like thereof. It thus will be recognized that due to the interaction of the chain conveyor and its entrainment members 15 with the vehicles 2 the latter are conveyed at a predeterminate travel velocity through the transfer section or path 8.

Now importantly according to the invention this predeterminate travel or transport velocity at the region of the chain conveyor 13 is not equal to the travel velocity of the vehicles 2 at the respective disembarking section 7 and the embarking section 9, rather it is appreciably greater in relation thereto. To achieve this greater velocity of the vehicles 2 there are advantageously provided acceleration means or expedients 16 which are effective at a substantially linear starting portion 17 of the transfer section or path 18 before or upstream, as viewed with respect to the direction of vehicle travel 5, of the curved portions of the transfer section 8 and which are here structured as curved or arcuate portions 8*a* and 8*b* each amounting to about one-quarter of a circle. At a substantially linear end or terminal portion 18 of this transfer section or path 8 there are also effective the deceleration means or expedients 19 which decelerate or brake the cabins 2*d* of the vehicles 2 from the predeterminate velocity of the chain conveyor 13 to the travel velocity desired at the embarking section or path 9.

In the illustrated exemplary embodiment, the acceleration means 16 and the deceleration means 19 are constructed as wheels or wheel members 20, 21 and 22, 23, respectively, each of which form an extension or prolongation of the related wheel sets 11 and 12, respectively. The drive of the wheels 20, 21 and 22, 23, respectively, is accomplished from the neighboring wheels of the wheel sets 11 and 12 by any suitable power transmitting elements, for instance not particularly illustrated V-belts and V-belt pulleys. By virtue of the diameter stepping of the belt pulleys of the relevant or participating wheels, the latter have imparted thereto the stepped higher rotational speed, and specifically the wheel or wheel member 21 has a higher rotational speed than the wheel or wheel member 20 and the wheel or wheel member 23 has a lower rotational speed than that of the wheel or wheel member 22.

By reverting again to FIG. 1 it will be further apparent that both the drive for the wheel sets 11 and 12 as well as also for the chain conveyor 13 can be derived from the cable pulley or sheave 3. To that end, the cable pulley or sheave 3 can be operatively coupled with a suitable branched gearing or transmission system 24 which is in drive connection by means of the shafts 25 and 26 with the gearing or transmission means or devices 27 and 28, respectively. The wheel sets 11 and 12 are likewise driven by means of the shafts 29 and 30, respectively, from the gearing or transmission unit or means 27 likewise constructed as a branched gearing or transmission system or device.

Furthermore, it will be seen that the gearing or transmission means or device 28 is operatively connected by means of a shaft or shaft member 31 with the drive wheel 14 of the chain conveyor 13. This drive wheel 14 is constructed, for instance, as a sprocket wheel.

The mode of operation of the inventive overhead cable transport installation will now be explained with reference to FIG. 1 and in consideration of the various positions assumed by the vehicles 2 or the like as they arrive at and move through the depicted station or terminal. The vehicles 2 which are located at a certain period of time in the related station have been conveniently indicated in FIG. 1 by reference characters A, B, C and so forth so as to be able to differentiate their momentary positions in the course of the following description.

At the disembarking section or path 7 there are located the vehicles 2 which assume the positions A, B, C. It will be recognized that the vehicle 2 at the position A has arrived at the disembarking section 7 at an assumed clock or time interval which has just elapsed. At the deceleration section or path 6 this vehicle 2, now in the position A, has been decelerated from the cable velocity of, for instance, 4 m/sec. to a travel velocity which affords a relatively comfortable or effortless disembarking of the passengers, for instance, a velocity of about 0.2 m/sec. Due to the reduction of the travel velocity of the vehicles 2 with constant time interval it will be readily evident that the vehicles 2 which have assumed the positions A, B, C have approached or come closer to one another to such an extent that their mutual spacing is less than the length of the cabin 2*d* of the vehicles 2.

It will be apparent that while the vehicle 2 at the position C is located shortly in front of or upstream of the track portion or region 17 equipped with the aforedescribed acceleration means 16, the next preceding or leading vehicle 2, located at the position D, has already travelled through this track portion 17 and is located at the operative region of the chain conveyor 13. Under the action of the acceleration means 16 the vehicle 2, shown in FIG. 1 at the position D, has imparted thereto a greater travel velocity, for instance 0.6 m/sec., which corresponds to the revolving or circulating velocity of the chain conveyor 13. The vehicle 2, shown at the position D in FIG. 1, thus has attained a greater spacing from the trailing vehicle 2, shown located at the position C in FIG. 1. The chain conveyor 13 thus transports the vehicle 2, depicted at position D in FIG. 1, now at this greater travel velocity.

It will be recognized that the vehicle 2, shown at position D in FIG. 1, during travel through the curved portions 8*a* and 8*b* of the transfer section or path 8 is neither hindered by the trailing vehicle 2 shown in FIG. 1 at the position C nor by the leading vehicle 2, shown at position E in FIG. 1.

This vehicle 2, depicted at position E in FIG. 1, has been transported during the just elapsed time interval from that position which is now assumed by the vehicle 2 at the position D, by means of the chain conveyor 13 at a constant travel velocity into the illustrated position E.

During the same time interval the vehicle 2, depicted in FIG. 1 at position F, has travelled through the track portion or region 18 and is thus decelerated or braked to the embarking velocity contemplated for the vehicles 2. At this velocity, which has been here represented to be of the same magnitude as the vehicle velocity at the disembarking section or path 7, there also moves along the embarking section or path 9 the vehicle 2, depicted in FIG. 1 at position G. The immediately leading vehicle 2, shown at the position H in FIG. 1, has departed from the embarking section or path 9 and now is accelerated at the acceleration section or path 10.

It is here to be remarked that the travel velocity of the vehicles 2 located at the disembarking section 7 and the embarking section 9 need not be identical. Quite to the contrary, the invention specifically contemplates, to the extent that such is advantageous, providing mutually different travel velocities for the vehicles at these sections 7 and 9.

It is also to be mentioned that the wheels 20, 21, 22 and 23, functioning as friction wheels, can be preferably designed as pneumatic wheels as such is, for instance, also possible for the wheels of the wheel sets 11 and 12.

It can also be desired to accommodate the spacing of the vehicles during passage through the station again to a predeterminate uniform clock (time interval between two successive vehicles 2). If that is desired then there can be arranged parallel to the chain conveyor 13 a clock conveyor or conveyor device at the transfer section or path 8, as the same has been disclosed in the aforementioned commonly assigned, co-pending U.S. application Ser. No. 07/132,898, filed Dec. 14, 1987, and entitled "Overhead Cable Transport Installation Containing a Transfer Section Equipped with a Clock Conveyor", to which reference may be readily had and the disclosure of which is incorporated herein by reference.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An overhead cable transport installation, comprising:

a station;

a revolving cable for transporting vehicles in a predetermined direction of travel and which can be coupled with the cable to said station;

means defining a path of travel, viewed with respect to the direction of travel of the vehicles arriving at the station, comprising:

a deceleration section;

a disembarking section;

a transfer section;

an embarking section located at a different location than said disembarking location;

an acceleration section;

brake means provided for decelerating the travel velocity of the vehicles at the deceleration section;

drive means for increasing the travel velocity of the vehicles at the acceleration section;

conveyor means for maintaining in motion the vehicles at the disembarking section, the transfer section and the embarking section;

said conveyor means including a conveyor system provided for the transfer section;

said conveyor system containing means for conveying the vehicles at the transfer section at a substantially constant velocity;

said conveyor system further containing acceleration means effective upstream of the means for conveying the vehicles at a substantially constant velocity at the transfer section, viewed with respect of the direction of travel of the vehicles, for accelerating the vehicles arriving at the transfer section; and said conveyor system further containing deceleration means which, viewed with respect to the direction of travel of the vehicles, are effective downstream of the means conveying the vehicles at substantially constant velocity and provided for the transfer section.

2. The overhead cable transport installation as defined in claim 1, wherein:

said transfer section includes at least two curved portions;

said acceleration means being arranged forward one of said curved portions; and said deceleration means being arranged after the other one of said at least two curved portions.

3. The overhead cable transport installation as defined in claim 1, wherein:

said acceleration means comprises at least one driven wheel;

said deceleration means comprises at least one driven wheel;

each of said vehicles having a friction element rigidly connected therewith; and each of said wheels coacting with said friction elements of the vehicles.

4. The overhead cable transport installation as defined in claim 3, wherein:

said friction element of each vehicle comprises a friction shoe.

5. The overhead cable transport installation as defined in claim 2, wherein:

said acceleration means comprises at least one driven wheel;

said deceleration means comprises at least one driven wheel;

each of said vehicles having a friction element rigidly connected therewith; and each of said wheels coacting with said friction elements of the vehicles.

6. The overhead cable transport installation as defined in claim 5, wherein:

said friction element of each vehicle comprises a friction shoe.

7. The overhead cable transport installation as defined in claim 3, further including:

a cable pulley for driving said cable; and said cable pulley providing the motive power for driving said wheels.

8. The overhead cable transport installation as defined in claim 3, wherein:

said acceleration means comprises a plurality of said wheels constituting driven wheels; and said deceleration means comprises a plurality of said wheels constituting driven wheels.

9. The overhead cable transport installation as defined in claim 1, wherein:

said conveyor means for maintaining the vehicles in motion at the disembarking section and at the embarking section comprise respective wheel sets provided for said disembarking section and said embarking section;

said transfer section being provided with an acceleration portion provided with wheels;

said transfer section being further provided with a deceleration portion provided with wheels; and means for placing in driving connection the wheel sets of the disembarking section and the wheel sets of the embarking section respectively with the wheels of the acceleration portion and the deceleration portion as well as with the means conveying the vehicles at substantially constant velocity.

* * * * *